US007591764B2

(12) United States Patent
Zuckerman

(10) Patent No.: US 7,591,764 B2
(45) Date of Patent: Sep. 22, 2009

(54) EXERCISE APPARATUS

(75) Inventor: Brian Zuckerman, Los Angeles, CA (US)

(73) Assignee: Swimworks, Inc., Los Angeles, CA (US)

( * ) Notice: Subject to any disclaimer, the term of this patent is extended or adjusted under 35 U.S.C. 154(b) by 327 days.

(21) Appl. No.: 10/949,729

(22) Filed: Sep. 24, 2004

(65) Prior Publication Data

US 2006/0073944 A1 Apr. 6, 2006

(51) Int. Cl.
*A63B 69/10* (2006.01)

(52) U.S. Cl. ..... 482/56; 482/130; 482/142

(58) Field of Classification Search ..... 482/51, 482/55, 56, 91, 126, 142, 121–124, 129, 482/130, 60, 148, 904; 434/254; 601/23, 601/24, 33–35

See application file for complete search history.

(56) References Cited

U.S. PATENT DOCUMENTS

| | | | | | |
|---|---|---|---|---|---|
| 2,013,520 | A | * | 9/1935 | McDermott | 482/56 |
| 2,019,224 | A | | 10/1935 | Hess | |
| 4,140,312 | A | * | 2/1979 | Buchmann | 482/62 |
| 4,674,740 | A | * | 6/1987 | Iams et al. | 482/56 |
| 4,830,363 | A | * | 5/1989 | Kennedy | 482/56 |
| 4,844,450 | A | * | 7/1989 | Rodgers, Jr. | 482/56 |
| 5,029,848 | A | | 7/1991 | Sleamaker | |
| 5,158,513 | A | * | 10/1992 | Reeves | 482/56 |
| 5,282,748 | A | | 2/1994 | Little | |
| 5,328,427 | A | | 7/1994 | Sleamaker | |
| 5,354,251 | A | * | 10/1994 | Sleamaker | 482/96 |
| 5,376,060 | A | | 12/1994 | Murray | |
| 5,393,280 | A | | 2/1995 | Haviv | |
| 5,540,591 | A | | 7/1996 | Doane | |
| 6,352,493 | B1 | * | 3/2002 | Davis | 482/56 |
| 6,790,163 | B1 | * | 9/2004 | Van De Laarschot et al. | 482/56 |
| 2003/0092533 | A1 | * | 5/2003 | Hippensteel | 482/56 |
| 2005/0079964 | A1 | * | 4/2005 | Francavilla | 482/142 |

FOREIGN PATENT DOCUMENTS

| | | | |
|---|---|---|---|
| SU | 961723 | * | 9/1982 |

* cited by examiner

*Primary Examiner*—Loan H Thanh
*Assistant Examiner*—Tam Nguyen
(74) *Attorney, Agent, or Firm*—Mintz, Levin, Cohn, Ferris, Glovsky & Popeo, P.C.

(57) ABSTRACT

An apparatus for replicating swimming, rowing, cycling or other exercise modalities. An apparatus includes a base, a frame extending up from the base, and a support member coupled to a top portion of the frame. The apparatus further includes a forward-ascending bench. The bench includes a torso support section to support a user's torso, pivotally coupled to the support member, and configured for limited angular rotation about an axis parallel to at least a portion of the support member. The bench further includes left and right leg support sections, pivotally coupled to the torso support section, to support at least the user's thighs. The apparatus also includes a coupling member extending forward from the base, and configured to interchangeably couple with an exercise module.

15 Claims, 9 Drawing Sheets

EXERCISE APPARATUS

BACKGROUND

Exercise machines attempt to replicate work required by various muscles of the body to develop better physical fitness of those muscles and of the body in general. Since the early days of crude weight benches and simple stationary bicycles, exercise machines have been developed to be better for specific movements, more adaptable to a wider array of exercises, or more polished and advanced for easier production, marketing and distribution.

Some exercise machines have been developed to attempt to replicate a specific type of sport activity, such as biking, running, stair climbing, rowing and weight lifting. These machines offer variable resistance levels, computer program monitoring of vital statistics, and user-friendly control systems, all within a confined exercise space. However, typical sports activity-replicating machines such as stationary bikes, treadmills, stair-climbers, rowers, etc., can be only configured for one type of activity at a time.

Swimming, despite being one of the best forms of exercise, is one sport activity that is difficult to replicate on land due to the medium in which the original activity takes place. In water, a person is subjected to less gravitational force and substantially increased resistance in every direction under the surface of the water. Because of this medium, swimmers are known as having desirable physical attributes of more toned and balanced muscle mass, greater strength, and higher endurance than persons subjected to other forms of exercise or activity.

SUMMARY

Disclosed herein are apparatuses and systems for land-based replication swimming exercise. Further disclosed herein are apparatuses and systems for interchangeable exercise modalities that include replicated swimming exercises, biking, rowing, strength training, and other modalities.

In one embodiment, an exercise apparatus includes a base, a frame extending up from the base, and a support member coupled to a top portion of the frame, extending forward from the frame. The apparatus further includes a forward-ascending bench. The bench includes a torso support section to support a user's torso, pivotally coupled to the support member, and configured for limited angular rotation about an axis parallel to at least a portion of the support member. The bench further includes left and right leg support sections, pivotally coupled to the torso support section, to support at least the user's thighs. In an exemplary embodiment, the bench further includes adjustable left and right wing sections extending from opposite sides of the torso support section. The apparatus also includes a coupling member extending forward from the base, and adapted to interchangeably couple with an exercise module.

In another embodiment, an exercise apparatus includes a frame extending up from a base, and a coupling member. The coupling member extends forward and rearward from the base, and has forward and rearward coupling interfaces. Each coupling interface is adapted to releasably couple with an interchangeable exercise module. The apparatus further include a support member coupled to and extending forward from a top portion of the frame, and an articulated bench, adapted for being coupled to the support member or the exercise module. The bench includes an upper support section, and left and right lower support sections pivotally coupled with the upper support section.

In yet another embodiment, an exercise system includes a frame module and one or more interchangeable exercise modules. The frame module includes a base, a frame extending up from the base, a resistance mechanism mounted to the frame, a coupling member extending forward and rearward from the base and having forward and rearward coupling interfaces, and a support member coupled to and extending forward from a top portion of the frame. Each exercise module includes an attachment member adapted to releasably connect with the coupling member and to cooperate with the resistance mechanism to provide an exercise modality. The system further includes an articulated bench, adapted for being coupled to the support member or the attachment member based on the exercise modality then being used.

The details of one or more embodiments are set forth in the accompanying drawings and the description below. Other features, objects, and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes an exercise apparatus and system for replicating swimming exercises and other exercise modalities. In accordance with various embodiments, the exercise apparatus provides for a swimming exercise mode, in which the resistance paths as well as resistance amount of arm and leg movements in swimming motions are accurately reproduced. For example, the exercise apparatus is adapted to provide nearly obstruction-free movement of a user's arms and hands when the user is laying on a bench in a substantially horizontal position, and to simultaneously provide free movement, of at least a user's lower legs, particularly in vertical up-and-down movement. Accordingly, the configuration of the apparatuses and systems described herein uniquely provide for a swimming type workout, among other exercise modalities, without a user having to get into the water.

Figure 1:
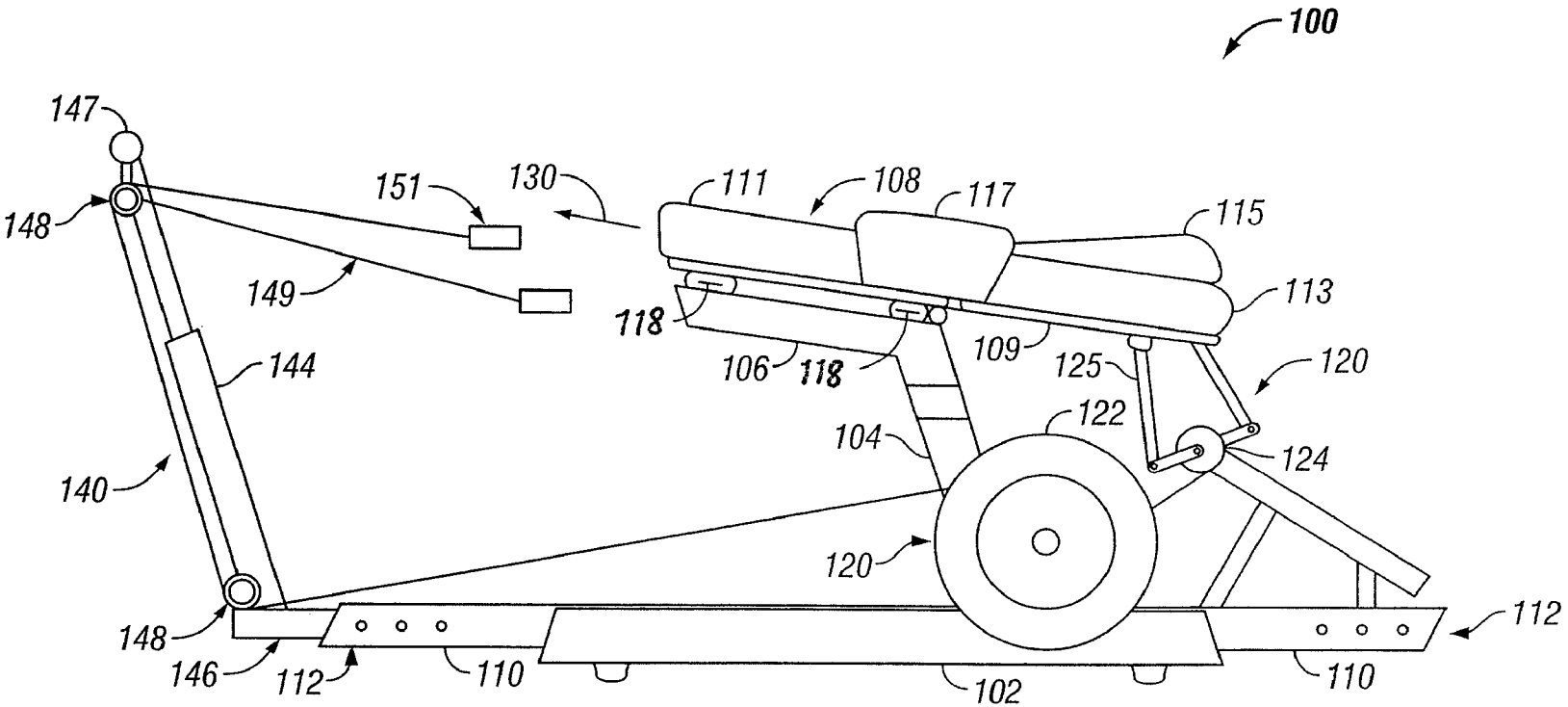
FIG. 1 is a side view of an exercise apparatus according to a first embodiment.

FIG. 1 is a side view of an exercise apparatus 100 according to a first embodiment. The apparatus 100 includes a base 102, a frame 104 coupled to and extending upward from the base 102, and a support member 106 coupled to and extending forward from a top portion of the frame 104. The base 102, frame 104, and support member 106 can be constructed of any rigid, weight-bearing and stress-resistant material, such as tubular or solid steel, aluminum, or other metal, nylon or any other suitable synthetic material.

The apparatus 100 further includes a bench 108 that ascends in a forward direction aligned with at least a portion of the support member 106. The bench 108 can be formed of a bendable but rigid lower layer 109 and a cushioning material applied to the lower layer 109. The cushioning material can be foam, thermoformed honeycomb, or any other cushioning material. The bench 108 is configured to provide multiple, independent axes of rotation for a user laying upon it, yet facilitates an ease of a user to get on or off the bench 108. The rotation can be configured to be variable, and adjusted according to two or more rotational range settings. In an embodiment, the bench 108 is adjustable in all coordinate axes for adjustability and comfort for a wide range of user's body types and weights. For instance, the bench 108 may include an indented area having an adjustable indentation for accommodating the bust area of women users. In another example, the bench is operable for being electro-mechanically raised or lowered.

The bench 108 includes a torso support section 111 that is pivotally coupled to the support member 106 to support a user's torso, and left and right leg support sections 113 and 115 that are pivotally coupled to the torso support section 111 to support at least the user's thighs. The torso support section 111 is preferably attached by pivoting members 118 that allow for limited angular rotation of the torso support section 111 about an axis 130 that is parallel to at least a portion of the support member 106. The bench 108 can also include left and right wing sections 117 extending from opposite sides of the torso support section 111 to cradle a user in operation. Wings can extend laterally or retract, fold up or down for cradling.

The apparatus 100 includes a coupling member 110 that extends forward and/or rearward from the base 102. The coupling member 110 has at least one coupling interface 112 adapted to interchangeably couple with an exercise module 140. In an embodiment, the coupling member 110 has front and rear coupling interfaces 112. The coupling interface 112 can include a hollowed interior portion of a tubular member, but can be configured as any type or arrangement suitable for releasably coupling the exercise module 140 to the rest of the apparatus 100, so that various exercise modules can be interchanged to accommodate multiple exercise modalities.

The apparatus 100 further includes a resistance mechanism 120 mounted to the frame 104 or base 102. The resistance mechanism 120 is adapted to cooperate with the exercise module 140 to provide the desired exercise modality. In one embodiment, the resistance mechanism 120 includes at least one variable resistance device, including, but not limited to, a flywheel, caliper brakes, alternator/generator, electromagnetic or electromechanical clutch, hydraulic resistance device, or centrifugal clutch. The flywheel may be mechanical, such as a wind-resistance flywheel, electromechanical, or electromagnetic. In an embodiment, the resistance mechanism 120 includes two or more separate resistance devices. For instance, the resistance mechanism 120 can include a flywheel 122 connected for providing a first resistance, such as to a user's arms, and a clutch or crank assembly 124 for providing a second resistance, such as to a user's legs. Those having skill in the art will recognize that any combination and number of resistance mechanisms can be used with any embodiment described herein.

As an example, FIG. 1 shows the apparatus 100 configured for a swimming exercise mode. The exercise module 140 includes an attachment mechanism 146 that couples to the coupling interface 112. In one embodiment, the attachment mechanism 146 is a rigid beam that slides into and locks within a cavity of the coupling interface 112. The exercise module 140 further includes a trunk member 144 that extends upward from the attachment mechanism 146, and left and right branch members 147. Each branch member 147 is coupled to a pulley 148 that is positioned for guiding a link 149 coupled between the resistance mechanism 120 and a user-controlled resistance activation device 151. The link 149 can include a cable, band, chain, and/or any other type of link. The user-controlled resistance activation device 151 can include a hand paddle connected to a cable, for instance. The resistance activation device 151 may also be a pedal and crank assembly such as used with a recumbent bicycle modality, or any other device that can be manipulated or moved by a user.

Figure 2:
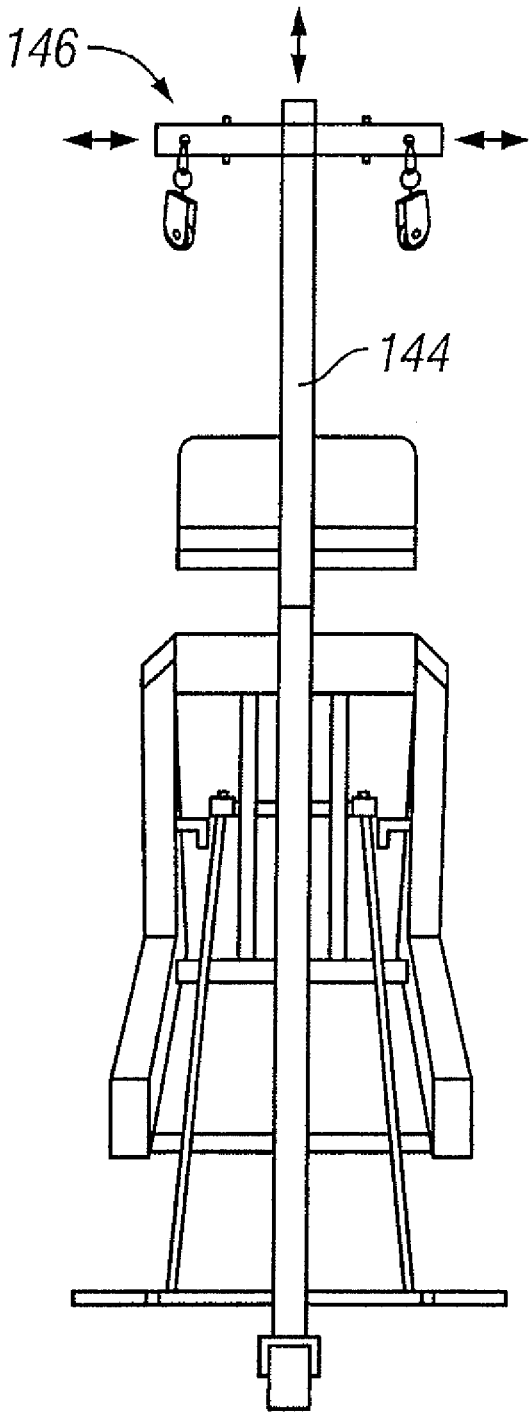
FIG. 2 is a frontal view of the exercise apparatus according to the first embodiment.

FIG. 2 is a frontal view of the exercise apparatus according to the first embodiment. The trunk member 144 may be telescopic, or otherwise adjustable to a vertical height desired by a user. A telescopic trunk member 144 can be formed of at least one beam slidably interfacing with another beam, and locked into a desired position by a pin or other locking member. The branch members 147 may also be telescopic and/or jointed, so that they may be adjustable to a particular position in the lateral, forward and/or backward direction. In an embodiment, the branch members are connected to the trunk member by a joint. The adjustability of the trunk member 144 and branch members 147 can be electrical, mechanical, or a combination thereof, and the process of adjustment by a user may be performed manually or automatically via a control interface.

Figure 3:
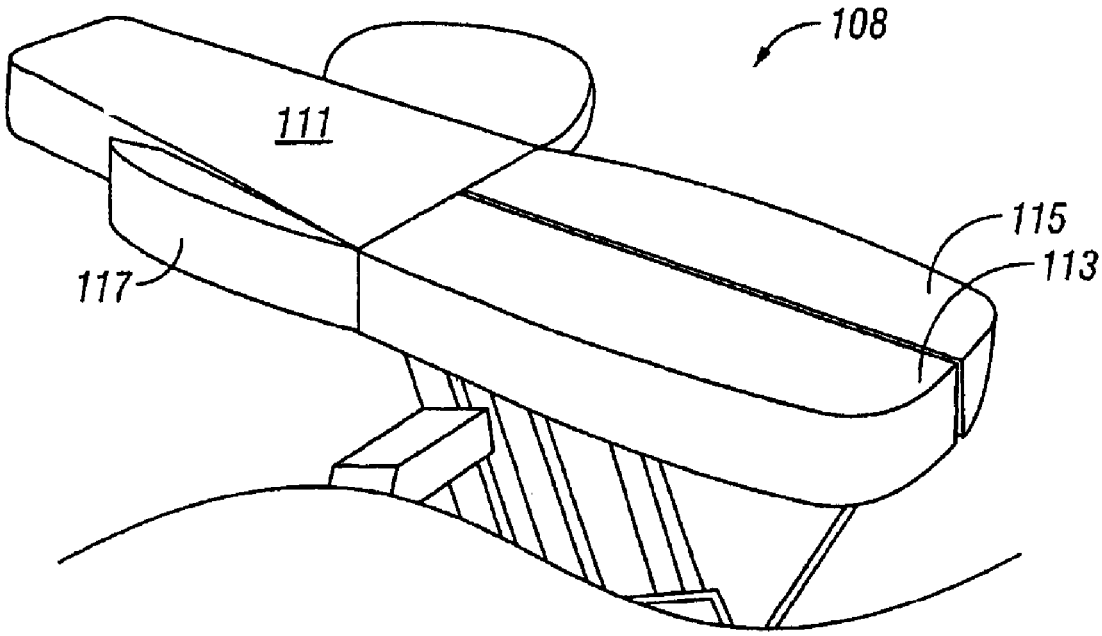
FIG. 3 is a perspective view of the exercise apparatus according to the first embodiment.

FIG. 3 is a perspective view of the exercise apparatus according to the first embodiment, to illustrate the composition and orientation of the bench 108. As discussed with reference to FIG. 1, the bench 108 provides multiple independent axes, of limited angles, of rotation 6f a user's body. The 108 includes a pivoting torso support section 111, left and right leg support sections 113 and 1 5 that are pivotally coupled to the torso support section 111 and left and right wing sections 117 extending laterally from opposite sides of the torso support section 111 to cradle a user. In an alternative embodiment, the torso support section 111 may be formed of two or more independently rotatable sections for a greater range of rotation. The top of the bench 108 can include a water- and/or sweat-proof coating.

Figure 4:
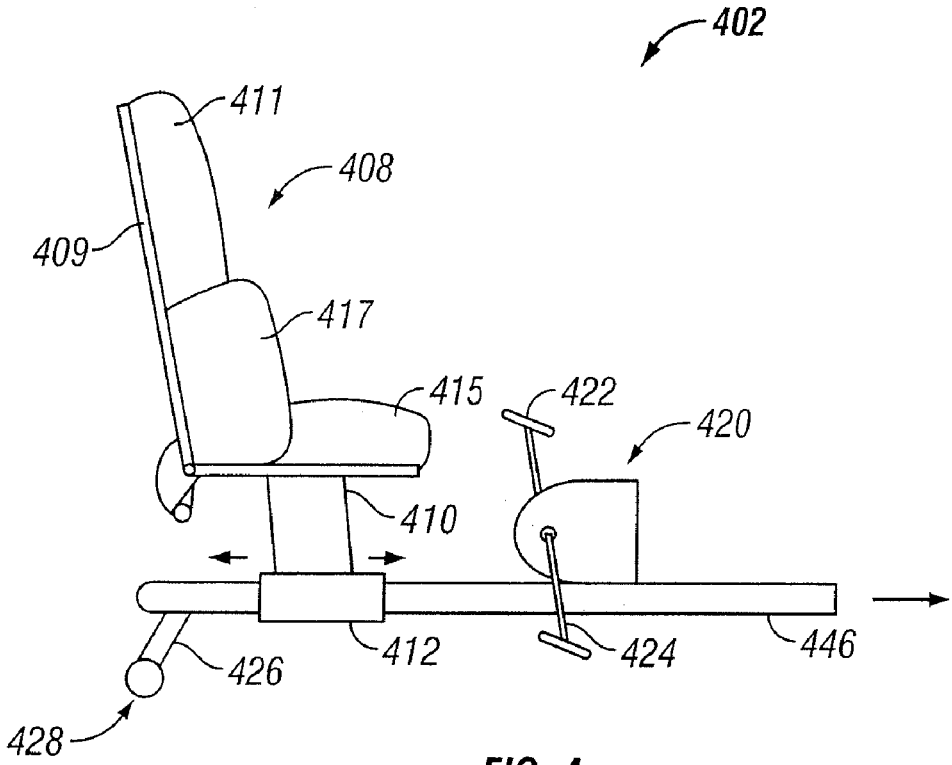
FIGS. 4 and 5 illustrate alternative interchangeable exercise modules for use with an exercise system.
Figure 5:
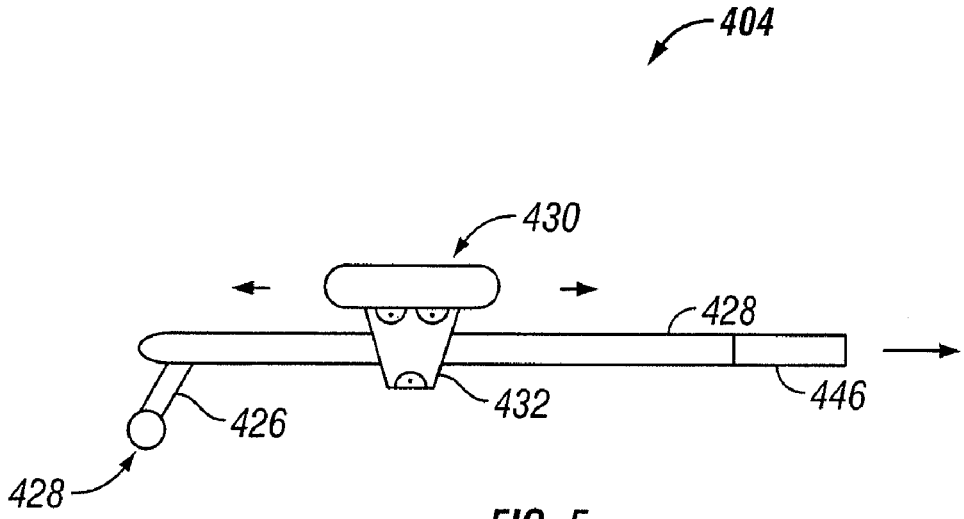
Figure 6A:
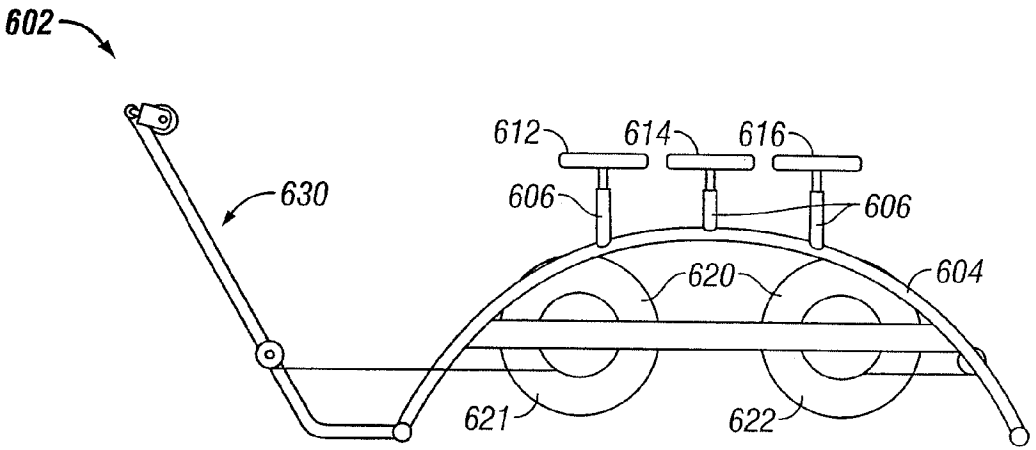
FIGS. 6A-6C are assorted views of an alternative embodiment of an exercise apparatus.
Figure 6B:
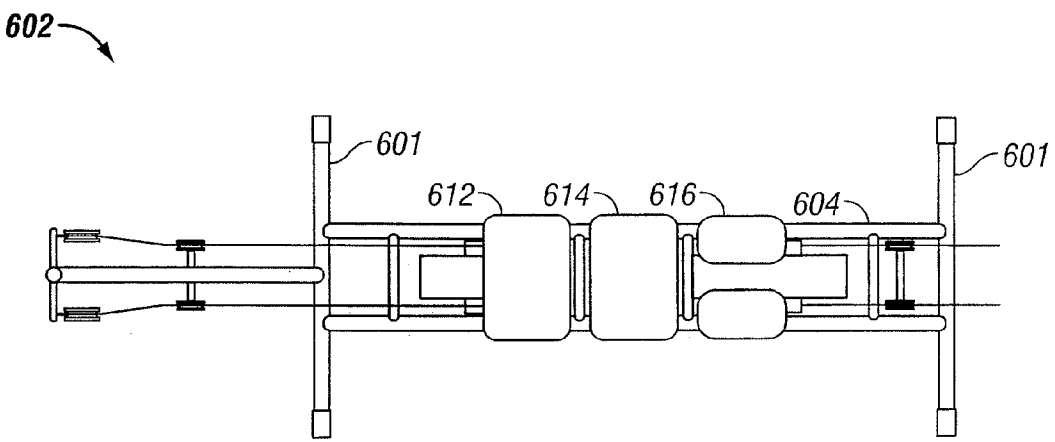
Figure 6C:
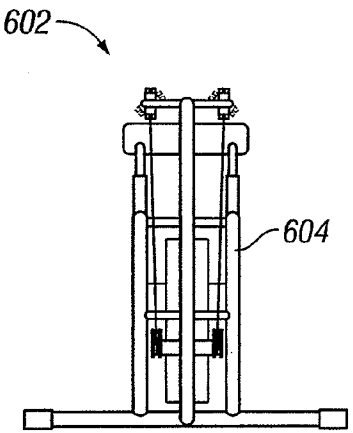

FIGS. 4 and 5 illustrate alternative interchangeable exercise modules for use with an exercise system. FIG. 4 shows a recumbent bicycle module 402, and FIG. 5 shows a rower module 404. Other modules for various other exercise modalities are possible. Each of the modules 402 and 404 include an attachment mechanism 446 that is configured to attach to a coupling interface of the rest of an exercise apparatus, as substantially described above with reference to FIG. 1. The modules 402 and 404 can also include one or more legs 426 for supporting the module in a particular vertical position. Each leg 426 may include a caster 428 or other rolling mechanism for facilitating attaching the module to the rest of the exercise apparatus.

The recumbent bicycle module 402 includes a bench 408 having a rigid layer 409 with both back and seat support parts. The bench 408 further includes a torso support section 411, and a seat support section 415, each having a cushioning layer. The bench 408 can further include left and right wing sections 417. In one embodiment, the bench 108 is configured for being interchangeable between the swimming exercise mode and the recumbent bicycle module 402. The bench 108 can be either locked in a folded position for use as a bicycle seat, as shown by bench 408, or locked in a flattened position for use in the swimming exercise mode, as shown by bench 108 of FIG. 1.

The bench 408 is connected to the attachment mechanism 446 by a seat stand 410 and seat coupling mechanism 412. The seat coupling mechanism 412 can be adjusted for coupling at various locations along the horizontal length of the coupling mechanism 446. The module 402 may also include hand grips (not shown), coupled to either the bench 408 or the seat stand 410, for a user to grasp when exercising. The module 402 further includes a pedal and crank assembly 420. The pedal and crank assembly 420 includes a crank 424 connected to a device such as a sprocket or other resistance leverage mechanism, and left and right foot pedals 422. The pedal and crank assembly 420 is connected to the resistance mechanism of the exercise apparatus by a chain or other linking mechanism.

With reference to FIGS. 1 and 4, a strength training exercise apparatus may be formed by combination of bench 408 with the exercise module 140. For example, the bench 408 may be connected with the coupling member 110 and/or to coupling interface 112 (at the front or rear of the apparatus 100), such that a user can operate the resistance mechanism 120 by links 149. The bench 408 may face forward or rearward, and can be configured to be spun and locked into either position. Further, the bench 408 can be configured to tilt for exposing any of the user's muscles to direct resistance. In alternative embodiments, the bench 408 can be connected to the base 102, frame 104, support member 106, or attachment mechanism 146. For example, the bench 408 can be mounted to the support member 106, which may in turn by raised or lowered. The bench 408 can have a swimming exercise mode, in which it lays flat, and a strength training mode, in which it folds up to form a chair.

The rower module 404 shown in FIG. 5 includes a track member 428 including an elongated track, and a seat 430 slidably mounted in the track by a mounting mechanism 432. The mounting mechanism 432 can include one or more rollers or wheels that permit forward and backward movement of the seat 430. The seat 430 may be a simple one-piece seat, or include multiple support sections as the bench 408 shown in FIG. 4. In another embodiment, the seat 430 is stationary, and the track member 428 can include foot rests to provide leverage to a user who can engage and pull a chain or cable connected to the resistance mechanism of the exercise apparatus.

FIGS. 6-9 are assorted views of various alternative embodiments of an exercise apparatus. FIGS. 6A-6C show a side, top-down and front view, respectively, of an exercise apparatus 602. The apparatus 602 includes a base 601 comprised of lateral parallel bars, and a frame 604 comprised of two parallel arcuate frame members, as illustrated in FIG. 6B. The apparatus 602 further includes a support member 606 coupled to a top portion of the frame 604, comprised of a number of vertical posts, and a split bench comprised of an upper torso support section 612 to support a user's upper torso, a lower torso support section 614 to support a user's mid-section, and left and right leg support sections 616. The bench components can be attached to the frame 604 by a number of shocks. Each of the sections of the bench are movable with respect to the frame 604, either pivotally coupled for limited angular rotation about a longitudinal axis of the apparatus 602, or for limited up-and-down movement.

The apparatus 602 includes a resistance mechanism 620 having a forward resistance mechanism 621 for providing resistance to a user's arms, and a rear resistance mechanism 622 for providing resistance to a user's legs. An exercise module 630 is coupled to the frame 604 or base 601, and can be folded or disengaged for storage of the apparatus 602.

Figure 7A:
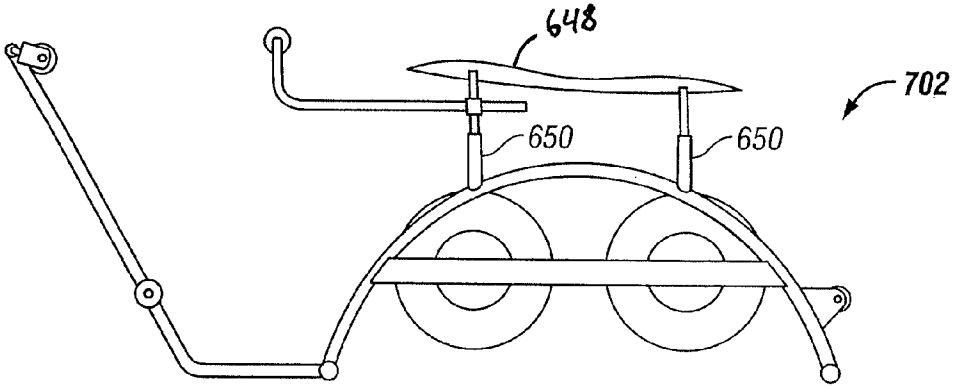
FIGS. 7A-7C are assorted views of another alternative embodiment of an exercise apparatus.
Figure 7B:
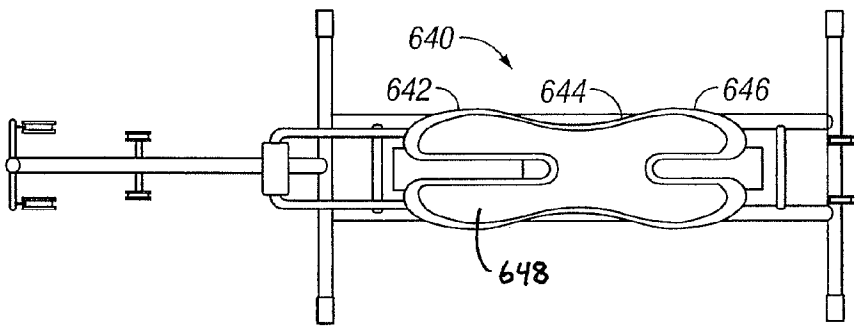
Figure 7C:
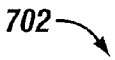
Figure 7C:
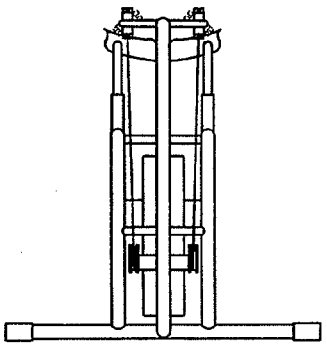

FIGS. 7A-7C show a side, top-down and front view, respectively, of an exercise apparatus 702 having a unitary bench 648. The unitary bench 648 includes left and right arms 642 and left and right legs 646, each flexibly connected to a midsection support 644, for allowing movement of a user's upper torso and shoulders and upper legs, respectively. The arms 642 and legs 646 of the bench 640 can be connected to the frame by shocks 650 or other biasing mechanisms. The unitary bench 648 can be formed of a resilient, stiff material such as plastic or carbon fiber, and may include several layers such as a stiffened lower layer and a padded upper layer.

Figure 8B:
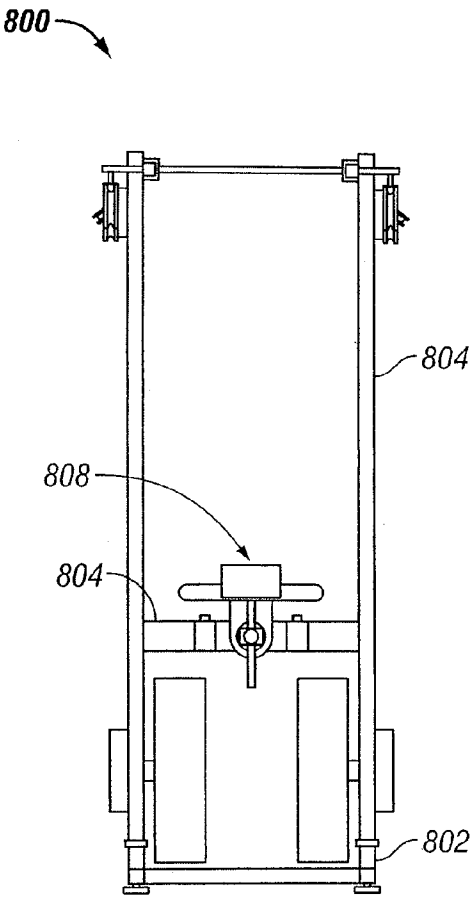
FIGS. 8A and 8B are respective side and frontal views of another alternative embodiment of an exercise apparatus.
Figure 8A:
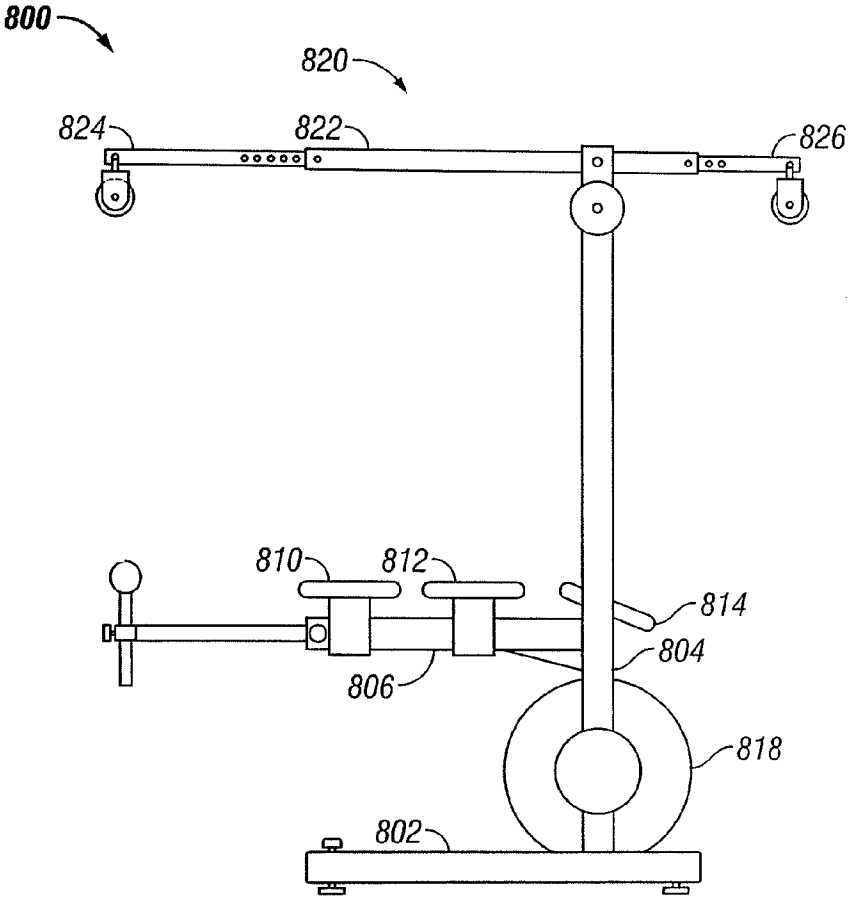

FIGS. 8A and 8B are respective side and frontal views of another alternative embodiment of an exercise apparatus 800. The apparatus 800 includes a base 802, and a frame 804 comprised of parallel beams extending substantially vertically from the base 802 and having a horizontal connection beam. A support member 806 extends forward from the frame 804, and supports a multi-sectioned bench 808. The bench 808 includes a torso support section 810, a midsection support section 812, and left and right thigh support sections 814.

The apparatus 800 includes an attachment module 820 having parallel longitudinal members 822 coupled to the top of respective parallel vertical beams of the frame 804. Each longitudinal member 822 includes a forward extending member 824 and a rear extending member 826, each telescoping to a desired length and coupled to a pulley for accommodating a cable connected to a resistance mechanism 818. The apparatus 800 thus provides resistance from above a user.

Figure 9A:
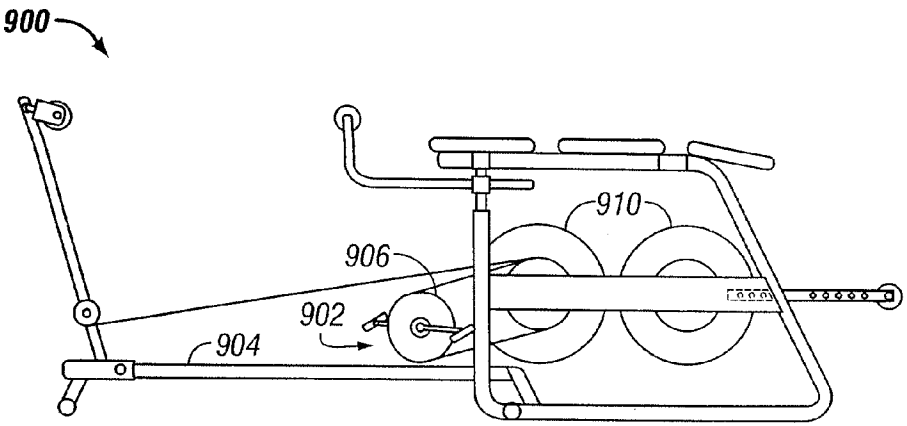
FIGS. 9A-9C are assorted views of yet another alternative embodiment of an exercise apparatus.
Figure 9B:
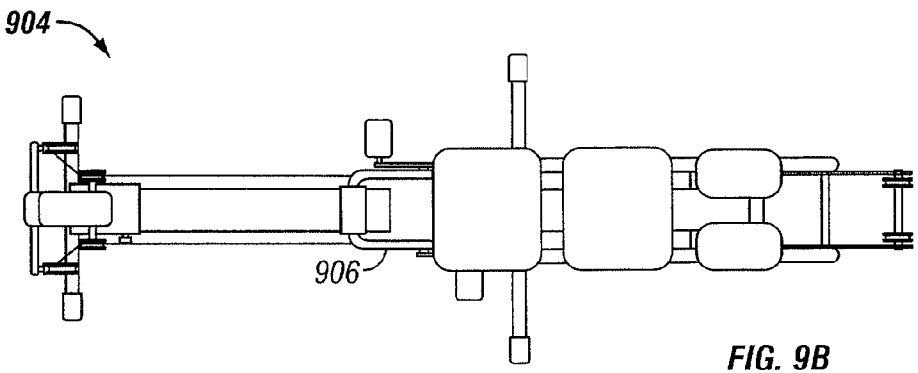
Figure 9C:
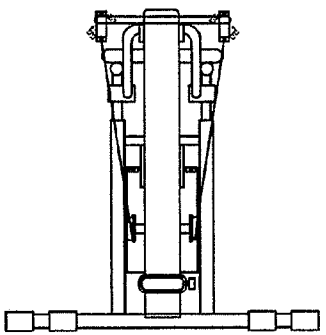

FIGS. 9A-9C are assorted views of yet another alternative embodiment of an exercise apparatus 900, showing an integrated exercise module 902 and removable exercise module 904. The integrated exercise module 902 includes a pedal and crank assembly 906, that may be coupled directly to a resistance mechanism. The integrated exercise module 902 may be used either by removal of the removable exercise module 904 and replacement by an alternative exercise module (not shown), or by attachment of the alternative exercise module, for example to a rear portion of the exercise apparatus 900. In the example shown, the alternative exercise module can include a seat for a recumbent bicycle.

Figure 10:
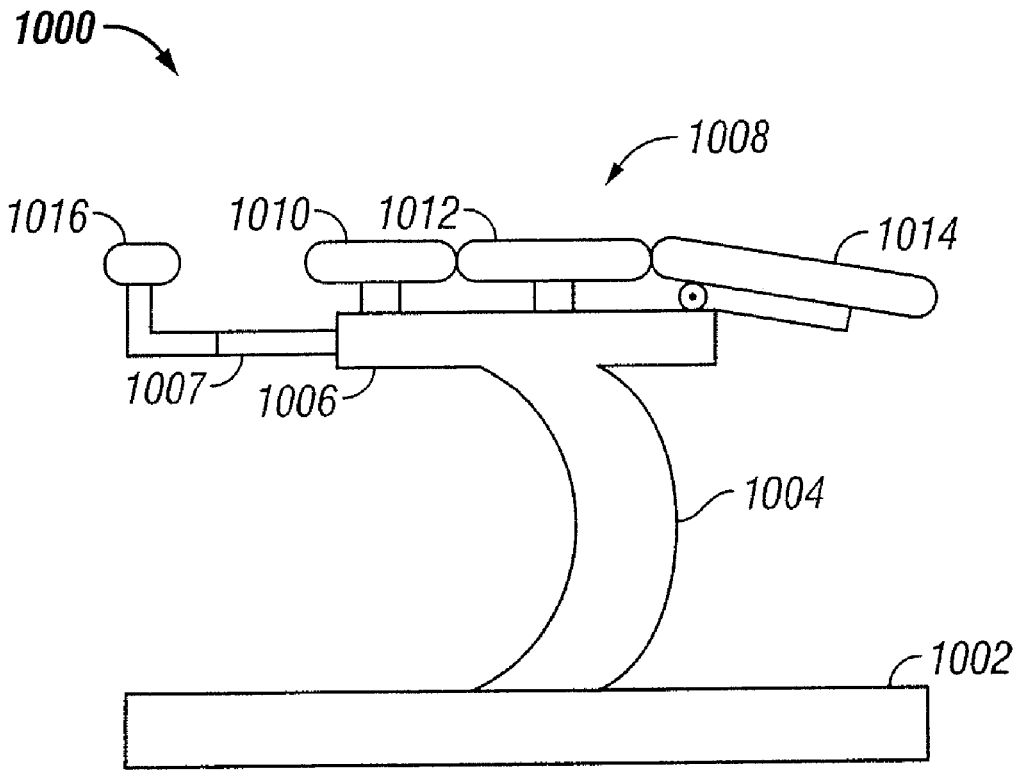
FIG. 10 illustrates an apparatus for instructing a person.

FIG. 10 illustrates an instruction apparatus 1000 for a land-based pool-free method of instructing a person on swimming techniques. The apparatus 1000 includes a base 1002, a frame 1004, and a support member 1006. The base 1002 anchors the apparatus to a stationary position on a substantially planar surface. The frame 1004 provides the support 1006 to a particular height, and can be adjustable to provide multiple, adjustable heights as well as angles of the support 1006.

The apparatus 1000 also includes a bench 1008 that has two or more sections having independent, limited ranges of rotation with respect to a common axis. The bench 1008 can be multi-sectional or of unitary construction. In an embodiment, the bench 1008 includes an upper torso support 1010, a midsection support 1012, and two leg supports 1014, each of which have their own rotation and/or angle of movement. The apparatus 1000 may also include a headrest 1016 extending from the support member 1006 via support connector 1007. The headrest 1016 may also be rotational. Each rotational section can be biased by a spring or gas-loaded shock absorber or other resistive device.

In a preferred embodiment, the apparatus 1000 is constructed of a light-weight metal or plastic, can be disassembled or compressed for portability, and set-up for rigid weight-bearing operation. The bench 1008 may be adjustable for person's of various size or weight, and may include wing sections that extend from opposing sides of the bench 1008.

In operation, the bench 1008 is adjusted to a predetermined height and/or angule. This can be done by adjusting the support member 1006 and/or frame 1004. A person is then placed on the bench 1008 and positioned on the bench 1008 at the appropriate location. Next, the person simulates swimming techniques, including but not limited to arm strokes, leg kicks, breathing, head turns, trunk rotation, and body arching. Other swimming techniques may be simulated. The person may also be provided resistance in order to train specific muscles. The resistance may be applied in a guided path to promote accomplishment of a specific technique for repeated action and muscle memory development. For example, resistance or weight may be provided to one or more of the person's limbs.

Although a few embodiments have been described in detail above, other modifications are possible. Other embodiments may be within the scope of the following claims.

What is claimed is:

1. An exercise apparatus, comprising:

a base;

a frame extending up from the base;

a support member coupled to a top portion of the frame, extending forward from the frame along an axis;

a forward-ascending bench, comprising:

a torso support section to support a user's torso, pivotally coupled to the support member, and configured for limited angular rotation about the axis;

left and right leg support sections, pivotally coupled to the torso support section, to support at least the user's thighs and pivot up or down based on movement of the user's legs;

left and right wing sections extending from opposite sides of the torso support section;

a coupling member extending forward from the base, and adapted to interchangeably couple with an exercise module; and a resistance mechanism mounted to the frame to provide a first resistance for the exercise module and a second resistance against movement of the left and right leg support sections.

2. An apparatus m accordance with claim 1, wherein the resistance mechanism is adapted to cooperate with the exercise module to provide an exercise modality.

3. An apparatus in accordance with claim 2, wherein the resistance mechanism includes a variable resistance assembly.

4. An apparatus in accordance with claim 3, wherein the variable resistance assembly includes at least one flywheel.

5. An apparatus in accordance with claim 3, wherein the resistance mechanism includes a link coupled between the variable resistance assembly and a user-controlled, resistance activation device.

6. An apparatus in accordance with claim 5, wherein the link includes a belt.

7. An apparatus in accordance with claim 5, wherein the user-controlled resistance activation device includes left and right hand paddles.

8. An apparatus in accordance with claim 2, wherein the exercise module includes an upwardly extending trunk member and left and right branch members, each branch member coupled to a pulley that is positioned for guiding a link coupled between the resistance mechanism and a user-controlled resistance activation device.

9. An apparatus in accordance with claim 2, wherein the exercise module includes a rear-facing seat and a pedal and crank assembly that is positioned for guiding a link coupled between the pedal and crank assembly and the resistance mechanism.

10. An apparatus in accordance with claim 2, wherein the exercise module includes a rower assembly having a track member including an elongated track, and a seat sidably mounted in the track.

11. An apparatus in accordance with claim 8, wherein the trunk member includes a telescopic trunk shaft.

12. An apparatus in accordance with claim 8, wherein each branch member includes a telescopic branch shaft.

13. An apparatus in accordance with claim 2, wherein the left and right leg support sections are coupled to the resistance mechanism.

14. An apparatus in accordance with claim 2, wherein the resistance mechanism includes a first resistance assembly configured to be operated by the user's arms and a second resistance assembly configured to be operated by the user's legs.

15. An apparatus in accordance with claim 14, wherein the first resistance assembly includes a flywheel.

* * * * *